US009287071B1

(12) United States Patent
Li et al.

(10) Patent No.: US 9,287,071 B1
(45) Date of Patent: Mar. 15, 2016

(54) HIGH-SAFETY SURGE PROTECTIVE DEVICE

(71) Applicant: Sichuan Zhongguang Lightning Protection Technologies Co., Ltd., Chengdu, Sichuan (CN)

(72) Inventors: Tianmi Li, Chengdu (CN); Xueying Wang, Chengdu (CN); Wei Wang, Chengdu (CN); Yi Ren, Chengdu (CN); Guohua Yang, Chengdu (CN)

(73) Assignee: SICHUAN ZHONGGUANG LIGHTNING PROTECTION TECHNOLOGIES CO., LTD., Chengdu (CN)

( * ) Notice: Subject to any disclaimer, the term of this patent is extended or adjusted under 35 U.S.C. 154(b) by 25 days.

(21) Appl. No.: 14/387,543

(22) PCT Filed: Mar. 10, 2014

(86) PCT No.: PCT/CN2014/073139

§ 371 (c)(1),
(2) Date: Sep. 23, 2014

(87) PCT Pub. No.: WO2014/166322

PCT Pub. Date: Oct. 16, 2014

(30) Foreign Application Priority Data

Apr. 10, 2013 (CN) ..... 2013 1 0123306

(51) Int. Cl.
*H01H 33/08* (2006.01)
*H01H 33/42* (2006.01)

(52) U.S. Cl.
CPC ..... *H01H 33/08* (2013.01); *H01H 33/42* (2013.01); *H01H 2223/038* (2013.01); *H01H 2235/01* (2013.01)

(58) Field of Classification Search
CPC ..... H01H 9/36; H01H 73/18; H01H 9/46; H01H 9/362; H01H 1/226; H01H 9/34; H01H 1/20; H01H 2050/028; H01H 33/10
See application file for complete search history.

(56) References Cited

U.S. PATENT DOCUMENTS 3,997,746 A * 12/1976 Harper ..... H01H 73/18 218/149
4,011,425 A * 3/1977 Gryctko ..... H01H 9/36 218/149
4,375,021 A * 2/1983 Pardini ..... H01H 9/36 218/25
4,656,446 A * 4/1987 Chien ..... H01H 1/2066 218/148
5,196,815 A * 3/1993 Chien ..... H01H 1/54 335/147
5,780,800 A * 7/1998 Palmieri ..... H01H 9/34 218/147
5,969,314 A * 10/1999 Rakus ..... H01H 9/46 218/14
6,248,970 B1 * 6/2001 DiMarco ..... H01H 9/34 218/149

(Continued)

FOREIGN PATENT DOCUMENTS

CN 102132467 A 7/2011

*Primary Examiner* — Truc Nguyen

(57) ABSTRACT

The invention relates to a high-safety surge protective device which comprises a casing, at least one overvoltage protection component inside the casing, a release unit used to separate the overvoltage protection component from the AC or DC circuit or the equipment, an arc suppressing apparatus used to suppress electric arc generated while separating the overvoltage protection component from the AC or DC circuit or the equipment, and a box, Wherein: the release unit comprises a compression spring, a metal dome, a slide and a soft conductor; the arc suppressing apparatus comprises an arc chute assembly, a first arc striking sheet, a second arc striking sheet, a turning block and a torsional spring.

18 Claims, 12 Drawing Sheets

(56) References Cited

U.S. PATENT DOCUMENTS 7,417,520 B2 * 8/2008 Kralik ..... H01H 9/34 200/10
7,812,276 B2 * 10/2010 Maloney ..... H01H 9/36 218/148
2006/0151437 A1 * 7/2006 Rakus ..... H01H 9/46 218/34
2008/0277382 A1 * 11/2008 Chen ..... H01H 9/36 218/151
2014/0202990 A1 * 7/2014 Puhalla ..... H01H 33/20 218/148

* cited by examiner

HIGH-SAFETY SURGE PROTECTIVE DEVICE

FIELD OF THE TECHNOLOGY

The present invention relates to a protective device for electrical equipment, particularly relates to a surge protective device.

BACKGROUND

With the development of electric power, communications and other industries, the surge protector is increasingly applied to a wider range and prone to more frequent failures during the application. However, fire and other accidents might occur if a deteriorated or overloaded surge protector is not separated from the AC or DC circuit and the equipment in a timely and safely manner, hence more and more concerns are given to the safety of such a deteriorated or overloaded surge protector.

CN102132467A disclosed an overvoltage discharge device with at least one discharge component. In the event of short circuit or immediate vicinity of the the overvoltage discharge device, its mobile isolating part will intrude into the motion circuit of the conductor section or the conducting bridge to prevent or inhibit the electric arc between the conducting element and the isolating part from being re-ignited. However, a thermal stability test in accordance with IEC61643.1-2005 shows that, the current running through the overvoltage discharge device exceeds 0.5 mA if a maximum continuous running voltage is applied, which is not compliant with the requirements of IEC61643-1:2005.

SUMMARY

The invention is intended to overcome shortcomings of the existing technology by providing a highly safe surge protector, so as to ensure the surge protector is separated from the circuit or the equipment when it is deteriorated or overloaded, thereby eliminating fire, electric leakage and other potential safety hazards.

The high-safety surge protective device disclosed in the invention comprises a casing, at least one overvoltage protection component inside the casing, a release unit used to separate the overvoltage protection component from the AC or DC circuit or the equipment, an arc suppressing apparatus and a box used to suppress electric arc generated while separating the overvoltage protection component from the AC or DC circuit or the equipment, the overvoltage protection component is provided with a first pin connected with the first electrode and a second pin connected with or separated from the second electrode through the release unit, and is mounted on the box; the release unit comprises a compression spring, a metal dome, a slide and a soft conductor, wherein: the slide is mounted inside the slideway of the box, the compression spring is in contact with the slide at one end and fixed on the box at the other end; the metal dome is mounted on the slide, its one end is connected with the soft conductor, while the other end is welded with the second pin of the overvoltage protection component when it is in normal condition, but when the overvoltage protection component is in abnormal condition and causes this end to separate from the second pin of the overvoltage protection component, an elastic restoring force of the compression spring is applied on the slide which drives the metal dome to move to the first limit wall on the box, the soft conductor is connected with the second electrode; theThe arc suppressing apparatus comprises an arc chute assembly, a first arc striking sheet, a second arc striking sheet, a turning block and a torsional spring, wherein: the turning block is a bar-type block with an arc reflector plate provided at one end, a mounting hole at the other end and a spark chamber at the part close to the arc reflector plate, the turning block is attached to the pin roll on the box through the mounting hole at its end and is hinged with this pin roll whose position is such that: when the overvoltage protection component is in normal condition, the side at the end of the turning block with the arc reflector plate is in contact with the metal dome, but when the overvoltage protection component is in abnormal condition and causes the metal dome to separate from it, the turning block moves to the second limit wall on the box under the action of the torsional spring and the spark chamber on the turning block covers the second pin of the overvoltage protection component separated from the metal dome; the torsional spring is mounted on the turning block and is connected with the pin roll; the arc chute assembly is installed inside the arc extinguishing chamber surrounded by the box and the casing, the first arc striking sheet has one end connected with or close to the left end of the arc chute assembly and the other end positioned on the box and close to the first limit wall, the second arc striking sheet has one end connected with or close to the right end of the arc chute assembly and the other end positioned on the box and close to the second limit wall.

The high-safety surge protective device disclosed in the invention also comprises an indicating device which further comprises a green display sheet and a red label, wherein the latter is attached on the upper end face of the slide and the former is hinged on the box; a transparent window is provided at the top of the housing of the casing from where the green display sheet or the red label is revealed. The green display sheet is revealed on the slide when the overvoltage protection component is in normal condition, but when the overvoltage protection component is in abnormal condition and causes the metal dome to separate from it, the green display sheet moves to the side of the box under the action of the slide and the red label attached on the upper end face is revealed.

The metal dome within the release unit of the high-safety surge protective device disclosed in the invention successively comprises an arc guide end, a welding contact face, a connecting arm, and a fixed end. The metal dome can be made of elastic copper, silver or alloy of these two, wherein elastic copper is preferred.

Braided annealed copper wire is preferred for the soft conductor within the release unit of the high-safety surge protective device disclosed in the invention.

An air outlet of the arc extinguishing chamber is made on the box of the high-safety surge protective device disclosed in the invention, and an exhaust port is made at the part on the housing of the casing corresponding to the air outlet of the arc extinguishing chamber.

The turning block within the arc suppressing apparatus of the high-safety surge protective device disclosed in the invention has a guide track groove between the spark chamber and the mounting hole, and a guide track matching the guide track groove is mounted at the corresponding part on the box.

The second arc striking sheet within the arc suppressing apparatus of the high-safety surge protective device disclosed in the invention is V-bulged at the part close to the second pin of the overvoltage protection component, in order to accelerate the arc striking speed.

The casing, box, slide and turning block of the high-safety surge protective device disclosed in the invention are made of gassing or non-gassing insulating material, wherein the former category is preferred as gas generated from such material can cool down the arc on the one hand and can, on the other hand, enhance the air-blowing function of the arc and accelerate the speed to move the arc to the arc chute assembly on the other hand. The gassing insulating material might be polyformaldehyde, nylon, or melamine.

The box of the high-safety surge protective device disclosed in the invention has two concrete structures as follows:

Firstly, on one facet of the box there is a chamber for the voltage protection component, while on the other facet there is an air outlet of the arc extinguishing chamber at the upper right top or on the side, a first limit wall at the upper left and a second limit wall at the lower right, wherein: a slideway for the slide is provided on the left of the first limit wall, a guide track for guiding the turning block to turn is provided on the left of the second limit wall together with a pin roll at its lower left.

Secondly, on one facet of the box there is a chamber for the voltage protection component, while on the other facet there is an air outlet of the arc extinguishing chamber on the upper right side, a first limit wall at the upper left, a third limit wall at the lower left and a second limit wall at the lower right, wherein: a slideway for the slide is provided on the left of the first limit wall, a guide track for guiding the turning block to turn is provided on the left of the second limit wall together with a pin roll beneath the guide track.

The high-safety surge protective device disclosed in the invention follows the operating principle as follows:

After long-time service or repeated impact, the overvoltage protection component (piezoresistor) is gradually deteriorated and its temperature rises little by little, or its temperature rises quickly when a tremendous overload current runs through. When the temperature at the weld between the second pin of the overvoltage protection component and the metal dome within the release unit reaches the melting or fusion point of the welding flux, the metal dome is separated from the second pin of the overvoltage protection component, thereby reliving the acting force applied on the turning block within the arc suppressing apparatus and on the compression spring within the release unit. In this way, the turning block within the arc suppressing apparatus turns towards the direction of the second limit wall on the box under the action of the elastic restoring force of the compression spring, while the slide within the release unit carries the metal dome to move towards the direction of the first limit wall on the box under the action of the elastic restoring force of the compression spring. As the turning block turns, the metal dome and the second pin of the overvoltage protection component which have been separated from each other are hence electrically isolated. Meanwhile, the arc generated while separating the metal dome from the second pin of the overvoltage protection component is cooled down and the impact wave moving backwards generated by the arc is reflected. The arc is made able to access the arc chute assembly as quickly as possible since the reflected wave and the impact wave move in the same direction towards the arc chute assembly. The first and the second arc striking sheet also play a part to lead the arc into the arc chute assembly. When the turning block reaches the second limit wall on the box, the spark chamber on the turning block covers the second pin of the overvoltage protection component. The distance between the metal dome and the second pin of the overvoltage protection component is continuously enlarged as the slide moves upward, and electrical isolation between the metal dome and the second pin of the overvoltage protection is completed when the slide carrying the metal dome reaches the first limit wall on the box.

The invention will render beneficial effects as follows:

Firstly, the arc suppressing apparatus of the high-safety surge protective device disclosed in the invention is constructed such that it can extinguish hard arc. The release unit of the high-safety surge protective device disclosed in the invention, on the other hand, can quickly release the metal dome from the second pin of the overvoltage protection component so as to complete quick electrical isolation between them. Therefore, the combination of the release unit and the arc suppressing apparatus ensures secure separation of the surge protector from the circuit or the equipment in the event of a failure, thereby solving the technical problem of small-current thermally-stabilized isolation and large-current overloaded isolation of the surge protector when it is used in an AC/DC system. The secure level is very high particularly when it is used in AC/DC circuit or equipment of high system voltage and large short circuit current (e.g. wind or photovoltaic power generating installation).

Secondly, the experiment shows that, when the slide carries the metal dome to reach the first limit wall on the box and completes separation of the metal dome from the second pin of the overvoltage protection component, the surge protector is completely isolated from the AC/DC circuit or the equipment and, when a maximum continuous running voltage is applied at its two ends, no current greater than 0.5 mA will run through, hence the high secure level.

Thirdly, as the high-safety surge protective device disclosed in the invention is provided with an indicating device, the operator can easily monitor the state of the overvoltage protection component, timely identify any failure and replace, so as to ensure the safety of the protected circuit or equipment.

Where: 1. casing; 11. housing; 111. exhaust port; 12. transparent window; 2. box; 201. air outlet of arc-extinguishing chamber; 202. first limit wall; 203. second limit wall; 204. pin roll; 205. guide track; 206. third limit wall; 3. overvoltage protection component; 311. first pin of overvoltage protection component; 312. second pin of overvoltage protection component; 4. release unit; 41. compression spring; 42. metal dome; 421. arc guide end; 422. welding contact face; 423. connecting arm; 424. fixed end; 43. slide; 44. soft conductor; 5. arc suppressing apparatus; 51. arc chute assembly; 511. mounting plate; 512. first arc chute; 513. second arc chute; 52. first arc striking sheet; 53. second arc striking sheet; 54. turning block; 541. arc reflector plate; 542. spark chamber; 543. guide track groove; 544. mounting hole; 55. compression spring; 6. indicating device; 61. green display sheet; 62. red label; 7. second electrode; 8. first electrode.

DETAILED DESCRIPTION

The following text further specifies the construction of the high-safety surge protective device disclosed in the invention in detail in consideration of the embodiments and accompanying drawings.

Example 1

Figure 1:
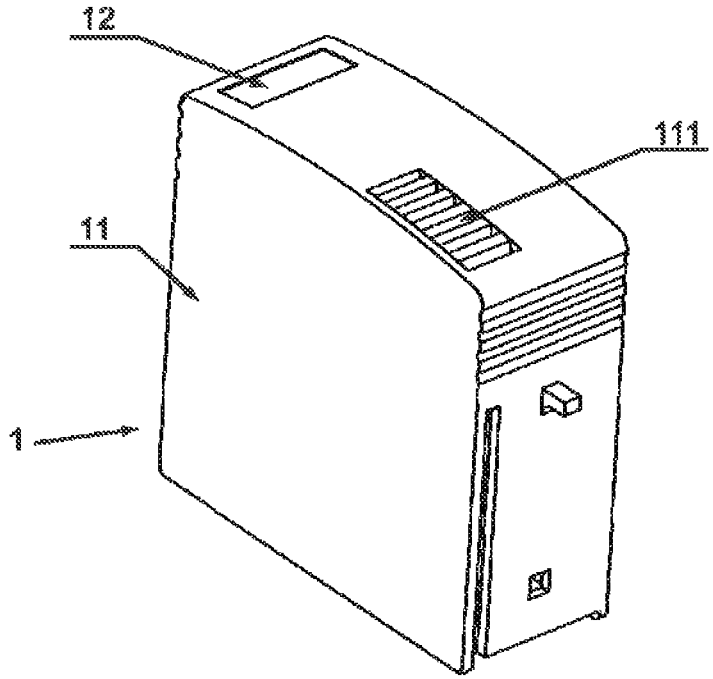
FIG. 1 is the first structural schematic view of the casing of the high-safety surge protective device disclosed in the invention.
Figure 5:
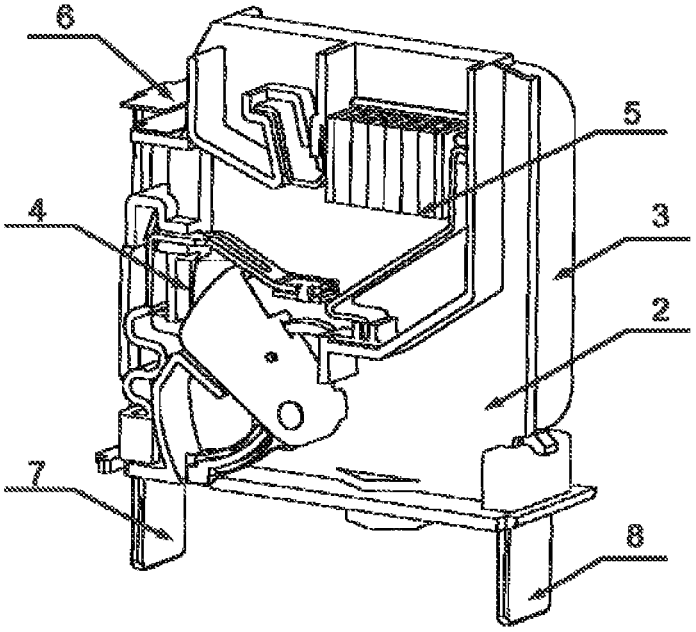
FIG. 5 is the second stereogram of functional devices and their combination within the high-safety surge protective device disclosed in the invention.
Figure 6:
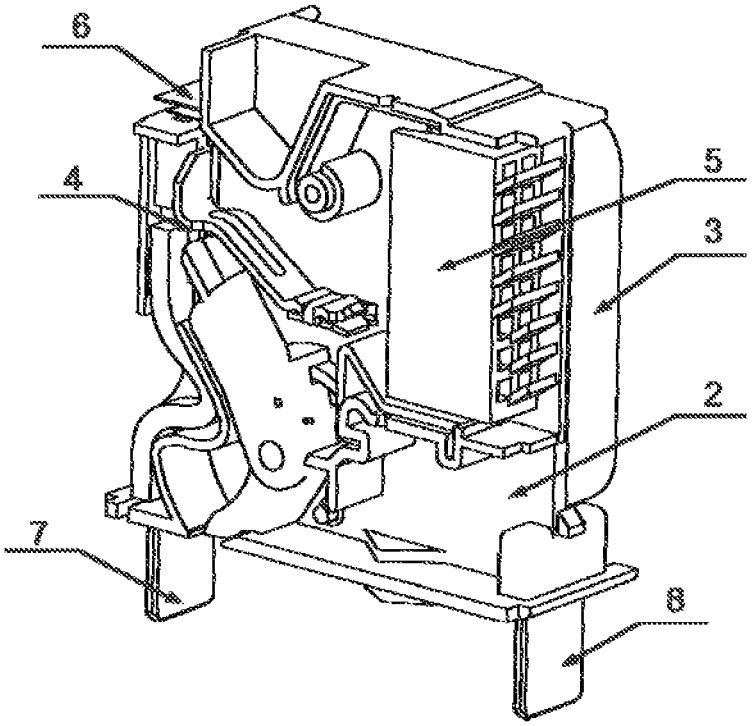
FIG. 6 is the third stereogram of functional devices and their combination within the high-safety surge protective device disclosed in the invention.
Figure 7:
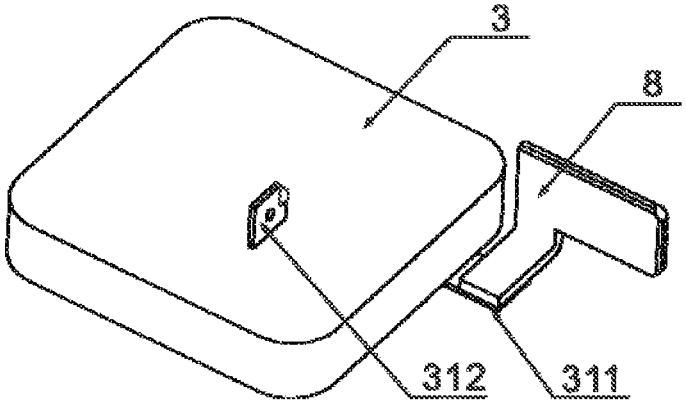
FIG. 7 is a schematic view of the connection between pins of the overvoltage protection component and the first electrode within the high-safety surge protective device disclosed in the invention.
Figure 8:
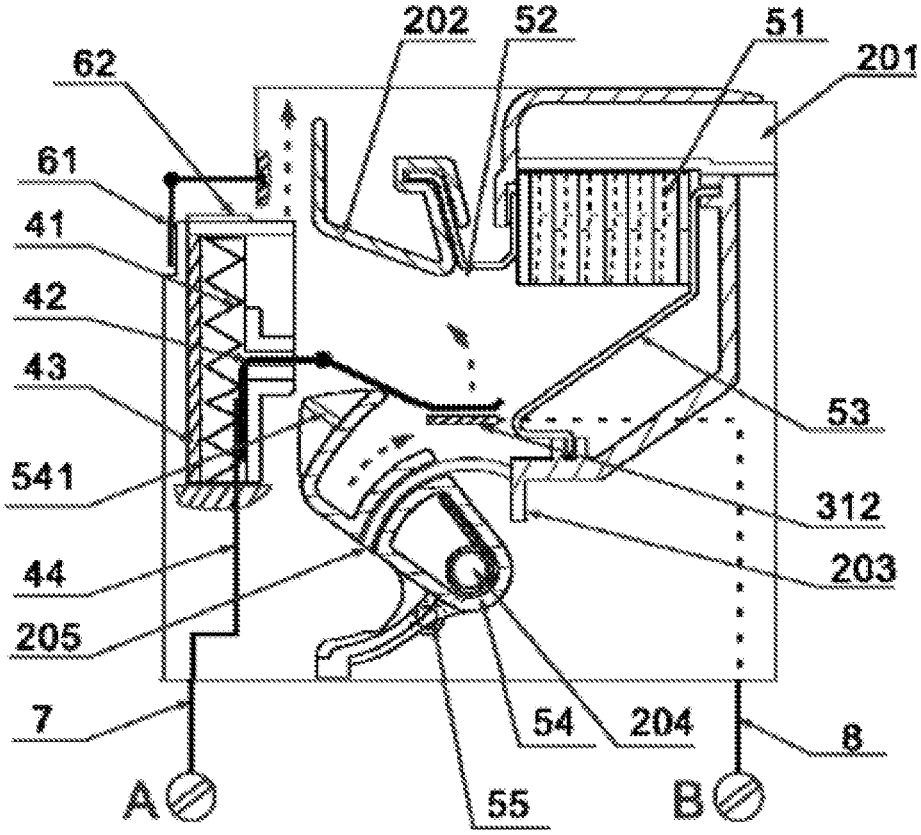
FIG. 8 is a plane projection of FIG. 4 showing the structure of the release unit, the arc suppressing apparatus and the indicating device, where: the metal dome within the release unit and the second pin of the overvoltage protection component are connected.
Figure 9:
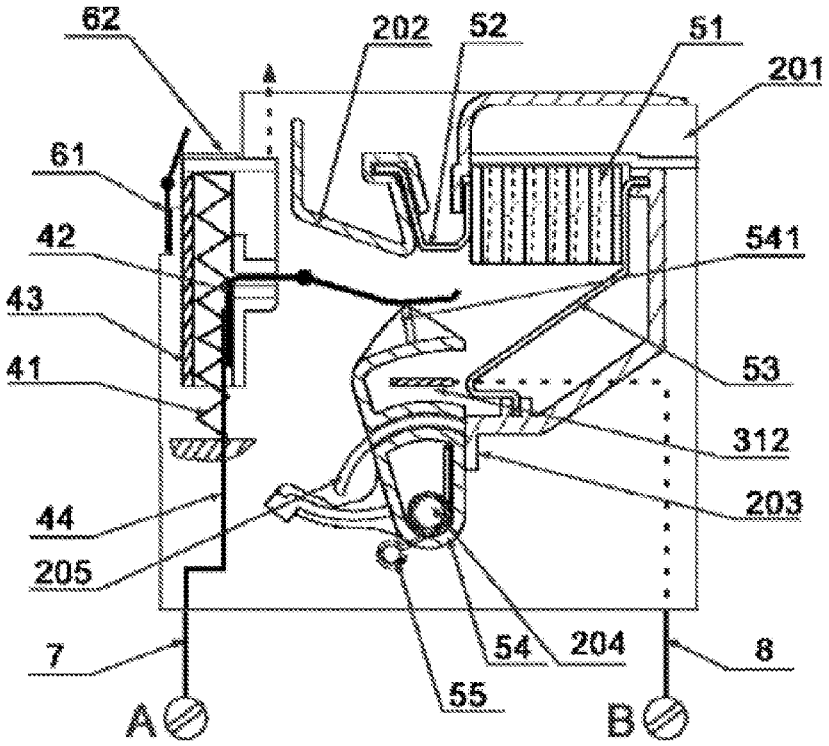
FIG. 9 is a plane projection of FIG. 4 showing the structure of the release unit, the arc suppressing apparatus and the indicating device, where: the metal dome within the release unit and the second pin of the overvoltage protection component are being separated.
Figure 10:
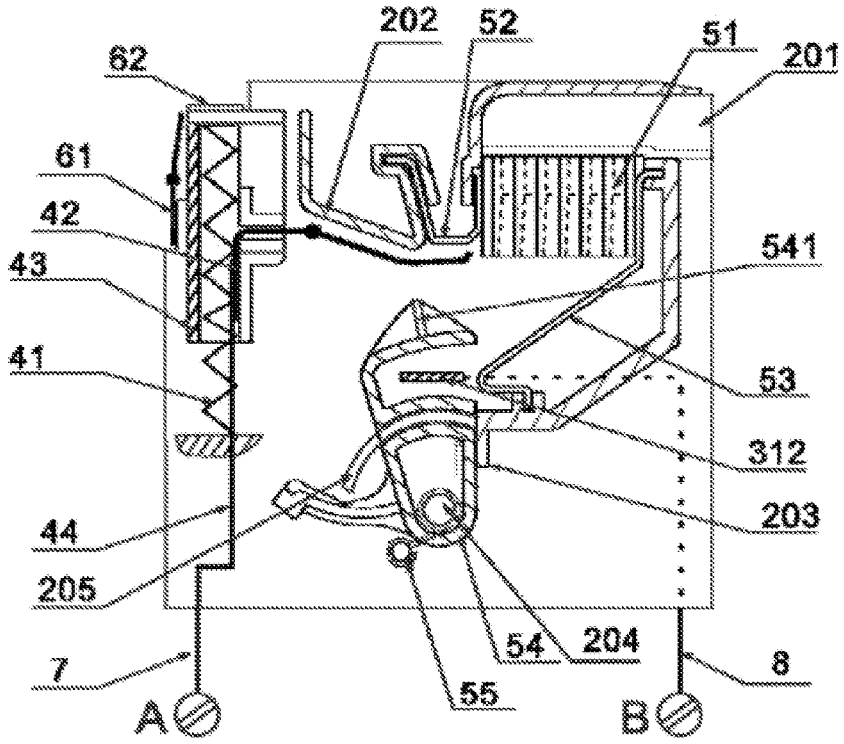
FIG. 10 is a plane projection of FIG. 4 showing the structure of the release unit, the arc suppressing apparatus and the indicating device, where: the metal dome within the release unit and the second pin of the overvoltage protection component are at the extreme position of separation.
Figure 11:
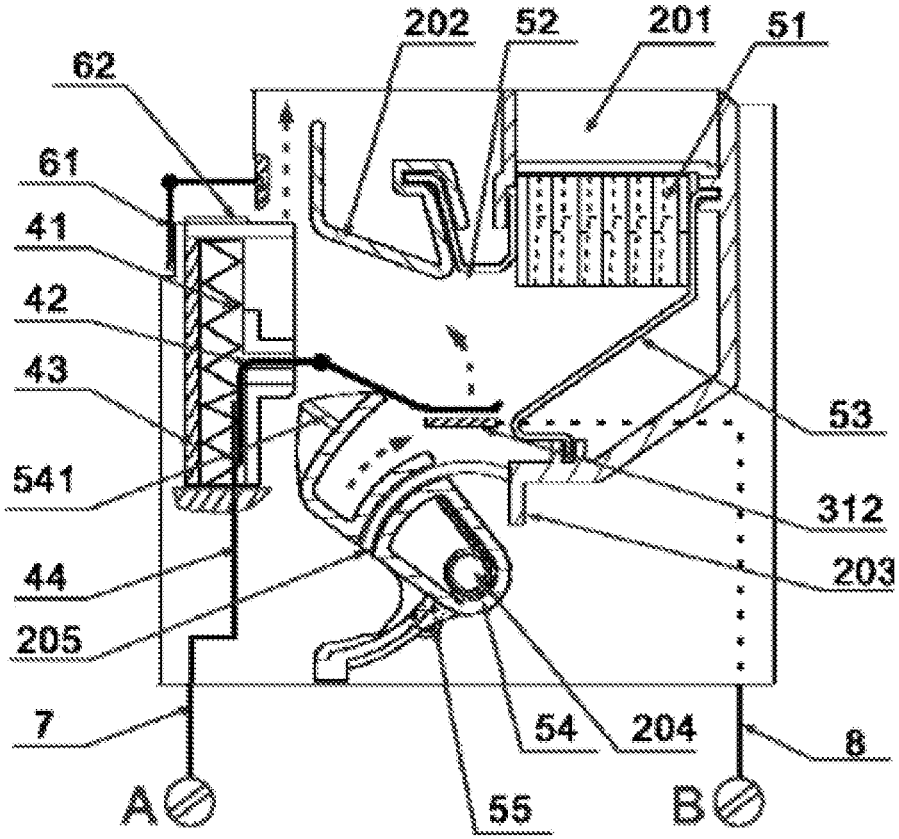
FIG. 11 is a plane projection of FIG. 5 showing the structure of the release unit, the arc suppressing apparatus and the indicating device, where: the metal dome within the release unit and the pin of the overvoltage protection component are connected.
Figure 12:
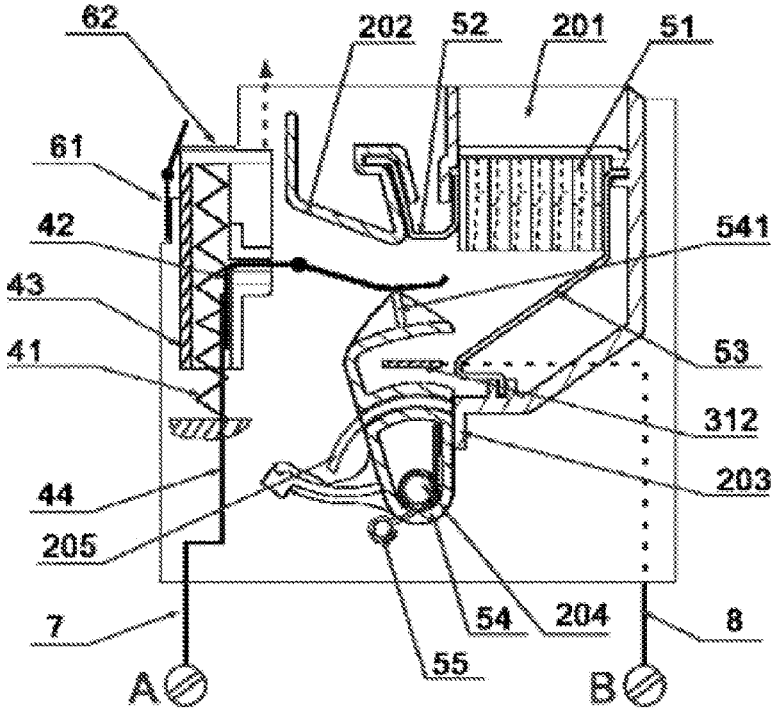
FIG. 12 is a plane projection of FIG. 5 showing the structure of the release unit, the arc suppressing apparatus and the indicating device, where: the metal dome within the release unit and the second pin of the overvoltage protection component are being separated.
Figure 13:
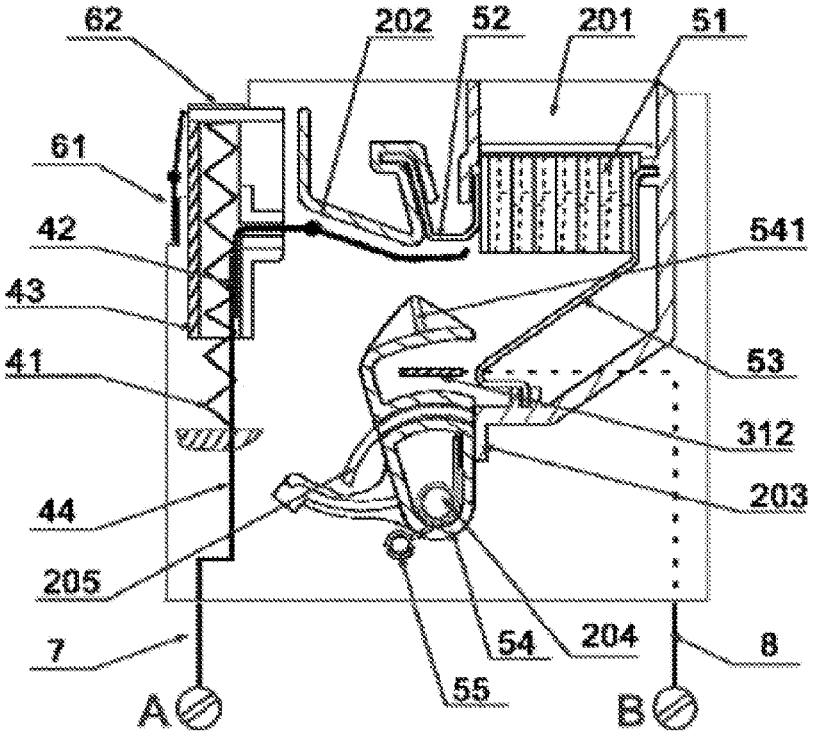
FIG. 13 is a plane projection of FIG. 5 showing the structure of the release unit, the arc suppressing apparatus and the indicating device, where: the metal dome within the release unit and the second pin of the overvoltage protection component are at the extreme position of separation.
Figure 14:
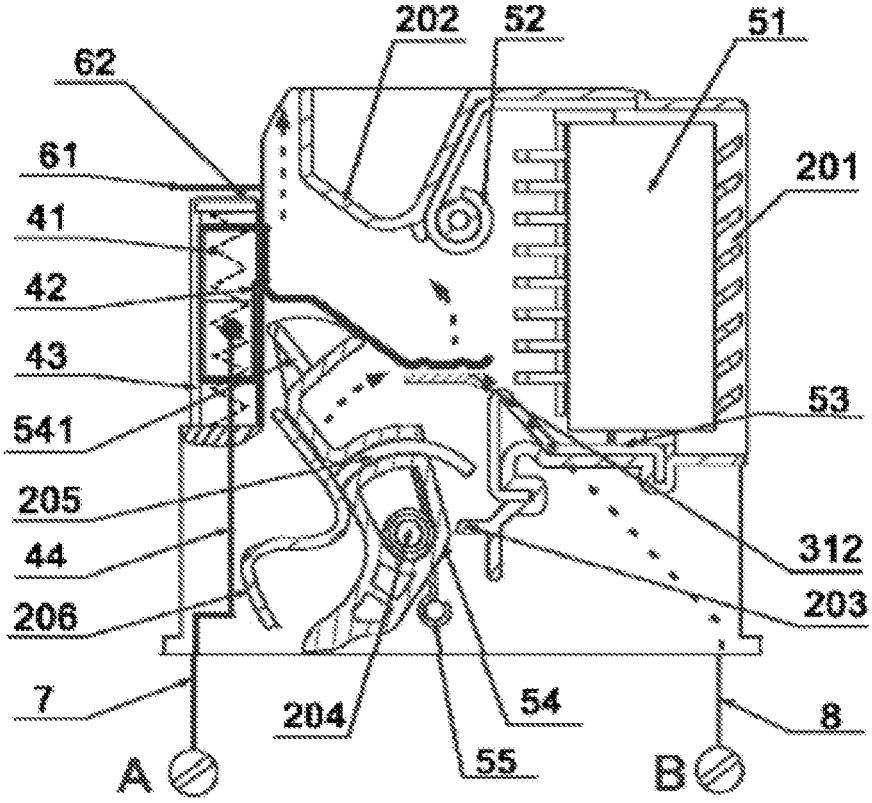
FIG. 14 is a plane projection of FIG. 6 showing the structure of the release unit, the arc suppressing apparatus and the indicating device, where: the metal dome within the release unit and the second pin of the overvoltage protection component are connected.
Figure 15:
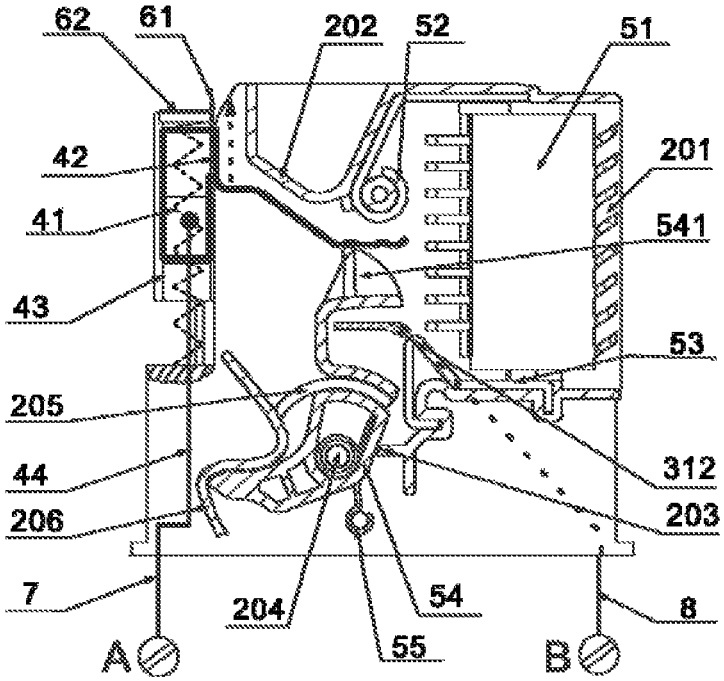
FIG. 15 is a plane projection of FIG. 6 showing the structure of the release unit, the arc suppressing apparatus and the indicating device, where: the metal dome within the release unit and the second pin of the overvoltage protection component are being separated.
Figure 16:
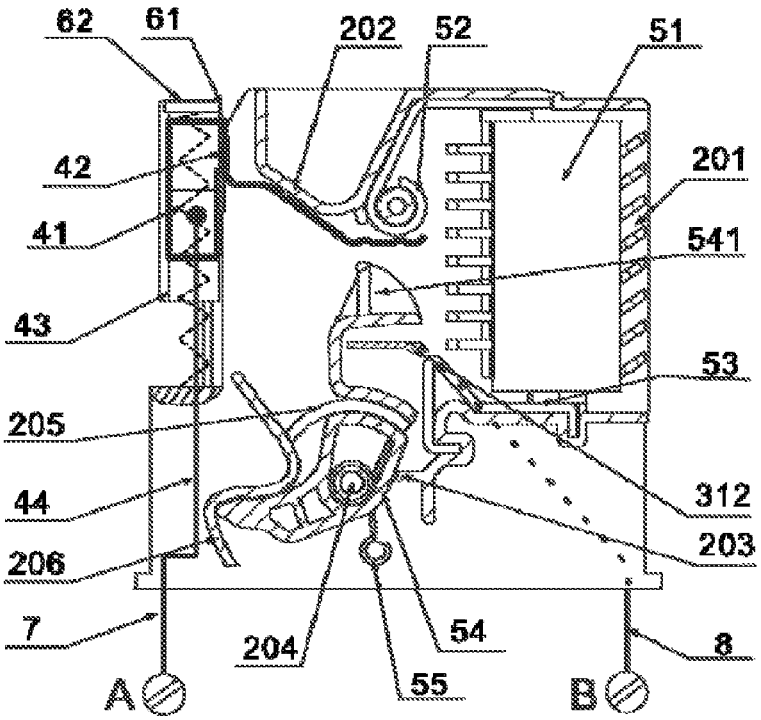
FIG. 16 is a plane projection of FIG. 5 showing the structure of the release unit, the arc suppressing apparatus and the indicating device, where: the metal dome within the release unit and the second pin of the overvoltage protection component are at the extreme position of separation.
Figure 17:
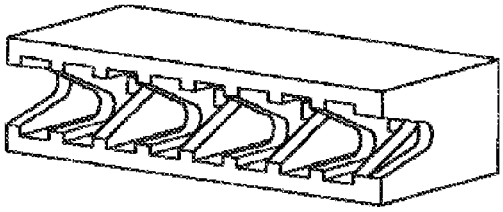
FIG. 17 is the first structural schematic view of the arc chute assembly.
Figure 18:
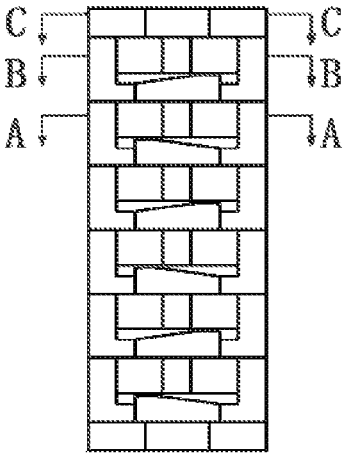
FIG. 18 is the front view of FIG. 17.
Figure 19:
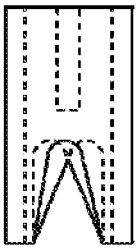
FIG. 19 is the top view of FIG. 17.
Figure 20:
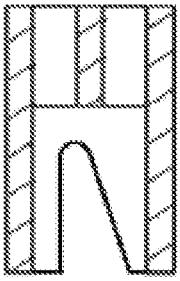
FIG. 20 is the A-A section view of FIG. 18.
Figure 21:
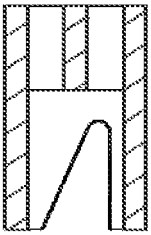
FIG. 21 is the B-B section view of FIG. 18.
Figure 22:
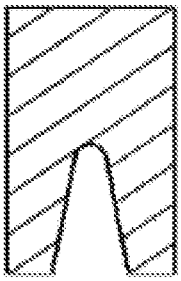
FIG. 22 is the C-C section view of FIG. 18.
Figure 23:
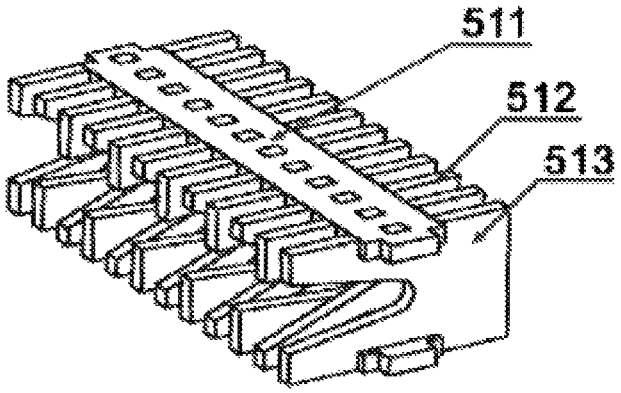
FIG. 23 is the second structural schematic view of the arc chute assembly.
Figure 24:
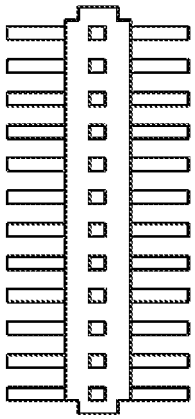
FIG. 24 is the front view of FIG. 23.
Figure 25:
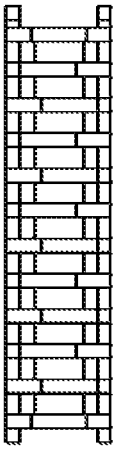
FIG. 25 is the left view of FIG. 23.
Figure 26:
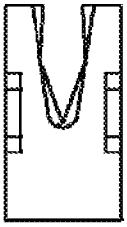
FIG. 26 is the top view of FIG. 23.
Figure 27:
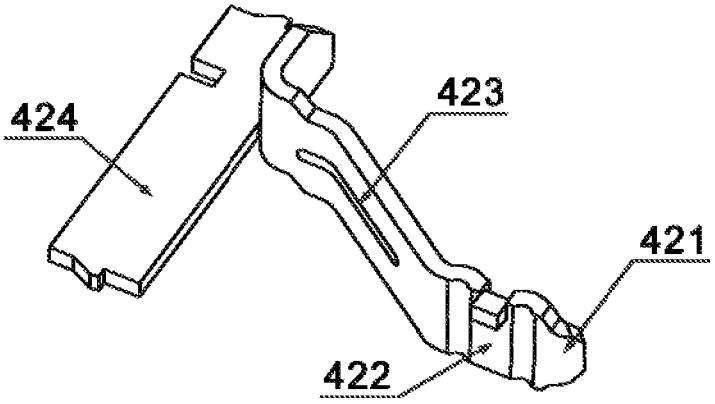
FIG. 27 is a structural schematic view of the metal dome.
Figure 28:
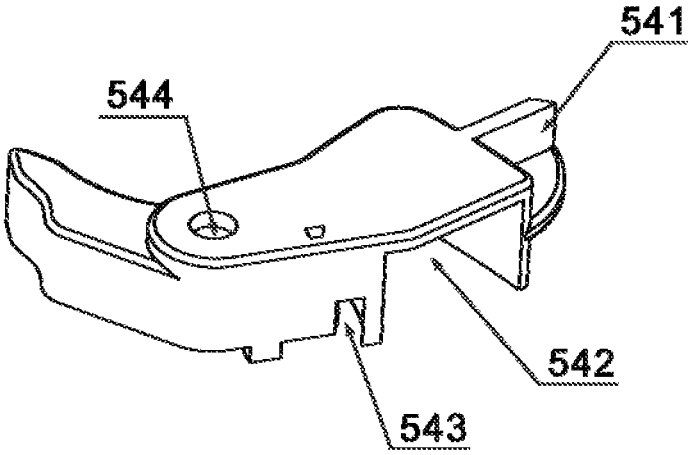
FIG. 28 is a structural schematic view of the turning block.

In this embodiment, the high-safety surge protective device comprises a casing 1 (see FIG. 1), an overvoltage protection component 3 within the casing, a release unit 4, an arc suppressing apparatus 5, an indicating device 6 and a box 2 (see FIG. 5). The housing 11 of the casing is approximate to a rectangular solid in shape and is made of nylon, with a transparent window 12 and an exhaust port 111 (see FIG. 1) provided at the top of the housing. The overvoltage protection component 3 is a piezoresistor with a first pin 311 and a second pin 312 (see FIG. 7), wherein the former is connected with the first electrode 8 while the second is connected with or separated from the second electrode 7 through the release unit. The box 2 is made of nylon, where on one facet is a chamber for the voltage protection component 3, while on the other facet is an air outlet of the arc extinguishing chamber 201 at the upper right top, a first limit wall 202 at the upper left and a second limit wall 203 at the lower right, wherein: a slideway for the slide is provided on the left of the first limit wall, a guide track 205 for guiding the turning block to turn is provided on the left of the second limit wall together with a pin roll 204 at its lower left (see FIG. 5, FIG. 11, FIG. 12, FIG. 13). The position of the pin roll 204 is required to be such that: when the overvoltage protection component is in normal condition, the side at the end of the turning block 54 within the arc suppressing apparatus where the arc reflector plate 541 is mounted contacts with the metal dome 42, but when the overvoltage protection component is in abnormal condition and causes the metal dome 42 to separate from it, the turning block moves to the second limit wall 203 on the box along the guide track under the action of the torsional spring 55 and the spark chamber 542 on the turning block covers the second pin of the overvoltage protection component separated from the metal dome. The release unit 4 comprises a compression spring 41, a metal dome 42, a slide 43 and a soft conductor 44 (see FIG. 11, FIG. 12, FIG. 13), wherein: the slide 43 is made of nylon and on its inside is a chamber for the compression spring; the metal dome 42 is made of elastic copper and comprises successively an arc guide end 421, a welding contact face 422, a connecting arm 423, and a fixed end 424 (see FIG. 27); the soft conductor 44 is a braided annealed copper wire; the slide 43 is mounted inside the slideway on the box; the compression spring 41 is mounted in the inner chamber of the slide, with its upper end contacted with the top of the inner chamber of the slide 43 and its lower end fixed on the box; the metal dome 42 is mounted on the slide, with its fixed end 424 connected with the soft conductor 44 and its welding contact face 422 brazed with the second pin 312 of the overvoltage protection component when it is in normal condition, but when the overvoltage protection component is in abnormal condition and causes the welding contact face 422 to separate from the second pin 312 of the overvoltage protection component, an elastic restoring force of the compression spring is applied on the slide which drives the metal dome to move upward to the first limit wall 202 at the upper left of the box; the soft conductor 44 is connected with the second electrode 7. The arc suppressing apparatus 5 comprises an arc chute assembly 51, a first arc striking sheet 52, a second arc striking sheet 53, a turning block 54 and a torsional spring 55 (see FIG. 11, FIG. 12, FIG. 13), wherein: the turning block 54 is a bar-type block made of nylon with an arc reflector plate 541 provided at its upper end, a mounting hole 544 at its lower end, a spark chamber 542 at the part close to the arc reflector plate, and a guide track groove 543 (see FIG. 28) between the spark chamber 542 and the mounting hole 544; the arc chute assembly 51 is of a monolithic construction as shown in FIG. 17, FIG. 18 and FIG. 19 and is moulded with ceramic, where its inside is interwoven into a labyrinth arc extinguishing structure by the cross sections as shown in FIG. 20 and FIG. 21; the first arc striking sheet 52 and the second arc striking sheet 53 are made of copper plated iron sheets; the turning block is attached to the pin roll 204 on the box through the mounting hole 544 at its lower end and is hinged with this pin roll; the torsional spring 55 is mounted on the turning block and is connected with the pin roll 204; the arc chute assembly 51 is installed inside the arc extinguishing chamber surrounded by the box 2 and the housing 11 of the casing; the first arc striking sheet 52 has one end connected with the left end of the arc chute assembly 51 and the other end positioned on the box and close to the first limit wall 202; the second arc striking sheet 53 has one end connected with the right end of the arc chute assembly 51 and the other end positioned on the box and close to the second limit wall. The second arc striking sheet 53 is V-bulged at the part close to the second pin 312 of the overvoltage protection component, in order to accelerate the arc striking speed. The indicating device 6 comprises a green display sheet 61 and a red label 62, wherein the former is attached on the upper end face of the slideway 43 and the latter is hinged on the box (see FIG. 11, FIG. 12, FIG. 13). When the overvoltage protection component is in normal condition, the green display sheet 61 is on the slide 43 and is hence revealed, but when the overvoltage protection component is in abnormal condition and causes the metal dome to separate from it, the green display sheet 61 turns to the side of the box under the action of the slide and the red label attached on the upper end of the slide 43 is hence revealed; a transparent window 12 is provided at the top of the housing from where the operator can observe.

Example 2

Figure 2:
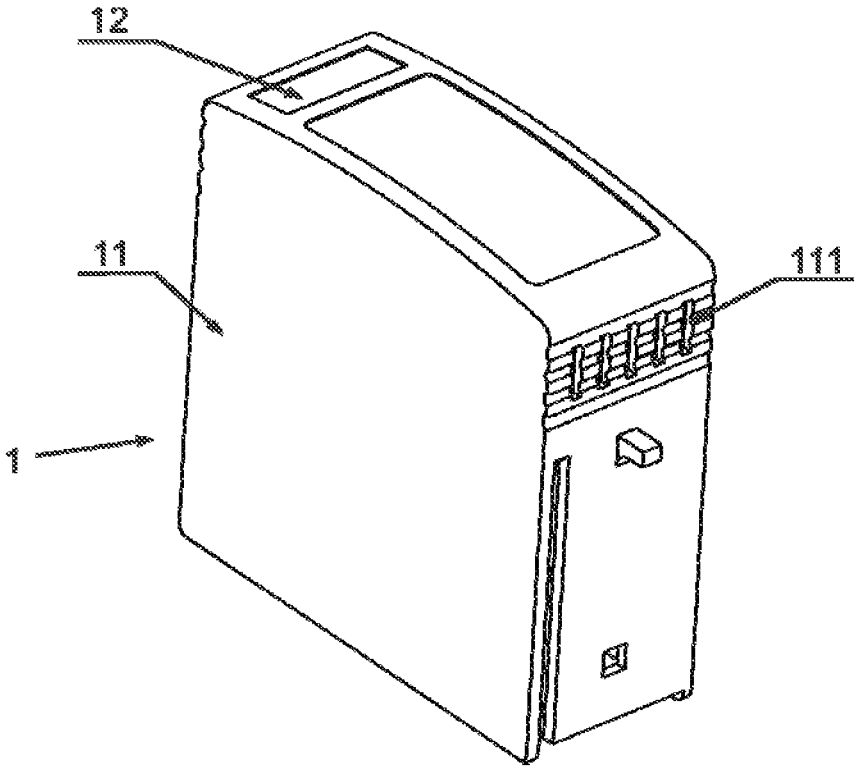
FIG. 2 is the second structural schematic view of the casing of the high-safety surge protective device disclosed in the invention.

In this embodiment, the high-safety surge protective device comprises a casing 1, an overvoltage protection component 3 within the casing, a release unit 4, an arc suppressing apparatus 5, an indicating device 6 and a box 2. What is different from Embodiment 1 is that: the exhaust port 111 is arranged on the upper right side of the housing 11 of the casing (see FIG. 2) and the air outlet of the arc extinguishing chamber 201 is arranged on the upper right side of the box 2 (see FIG. 4, FIG. 8, FIG. 9 and FIG. 10).

Example 3

Figure 3:
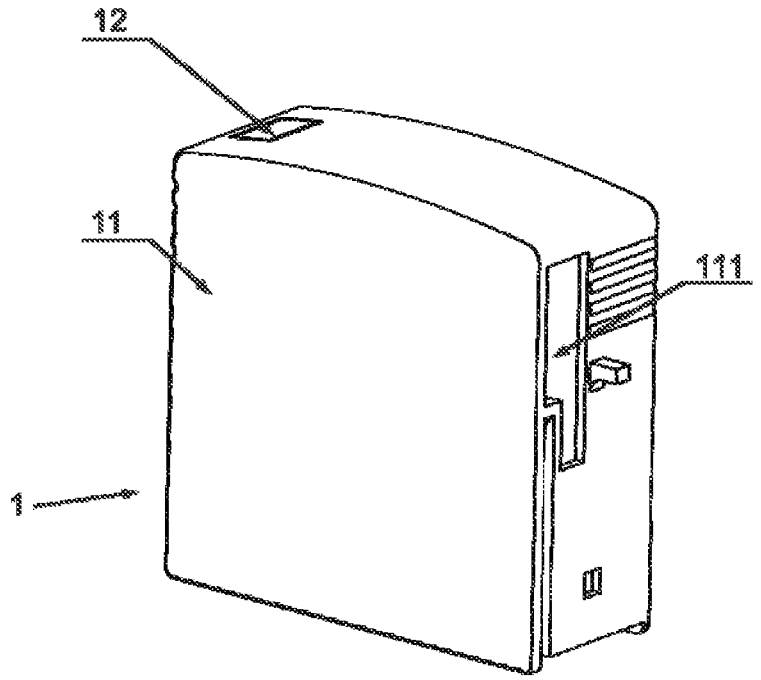
FIG. 3 is the third structural schematic view of the casing of the high-safety surge protective device disclosed in the invention.
Figure 4:
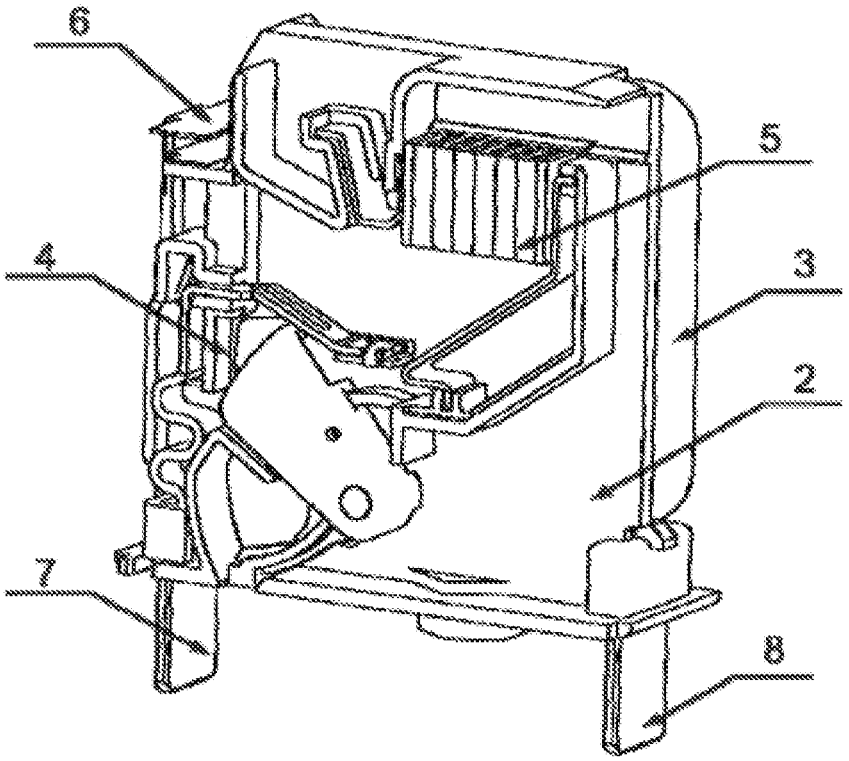
FIG. 4 is the first stereogram of functional devices and their combination within the high-safety surge protective device disclosed in the invention.

In this embodiment, the high-safety surge protective device comprises a casing 1, an overvoltage protection component 3 within the casing, a release unit 4, an arc suppressing apparatus 5, an indicating device 6 and a box 2. What is different from Embodiment 1 is that: the exhaust port 111 is arranged on the right side of the housing 11 of the casing (see FIG. 3) and the air outlet of the arc extinguishing chamber 201 is arranged on the upper right side of the box 2 (see FIG. 6, FIG. 14, FIG. 15 and FIG. 16); on one facet of the box 2 is a chamber for the voltage protection component 3, while on the other facet is an air outlet of the arc extinguishing chamber 201 at the upper right top, a first limit wall 202 at the upper left, a third limit wall 206 at the lower left a second limit wall 203 at the lower right, wherein: a slideway for the slide is provided on the left of the first limit wall, a guide track 205 for guiding the turning block to turn is provided on the left of the second limit wall together with a pin roll 204 beneath the guide track; when the voltage protection component 3 is in normal condition, the side at the end of the turning block 54 within the arc suppressing apparatus where the arc reflector plate 541 is mounted contacts with the metal dome 42 within the release unit and the left side o the turning block 54 is limited by the third limit wall 206 (see FIG. 6, FIG. 14, FIG. 15, and FIG. 16); the arc chute assembly 51 is of a labyrinth arc extinguishing structure formed by metal chutes as shown in FIG. 23, FIG. 24, FIG. 25 and FIG. 26; the first arc striking sheet 52 and the second arc striking sheet 53 are made of copper plated iron sheets; the arc chute assembly 51 is installed inside the arc extinguishing chamber surrounded by the box 2 and the housing 11 of the casing; the first arc striking sheet 52 has one end close to the left end of the arc chute assembly 51 (with certain interstice between them) and the other end positioned on the box and close to the first limit wall 202; the second arc striking sheet 53 has one end close to the right end of the arc chute assembly 51 and the other end positioned on the box and close to the second limit wall; the second arc striking sheet 53 is V-bulged at the part close to the second pin 312 of the overvoltage protection component, in order to accelerate the arc striking speed.

What is claimed is:

1. A high-safety surge protective device comprises: a casing (1), at least one overvoltage protection component (3) inside the casing, a release unit (4) used to separate the overvoltage protection component from an AC or DC circuit or an equipment, an arc suppressing apparatus (5) and a box (2) used to suppress electric arc generated while separating the overvoltage protection component from the AC or DC circuit or the equipment, the overvoltage protection component is provided with a first pin (311) connected with a first electrode (8) and a second pin (312) connected with or separated from a second electrode (7) through the release unit, and is mounted on a box; wherein: the release unit (4) comprises a compression spring (41), a metal dome (42), a slide (43) and a soft conductor (44); wherein: the slide (43) is mounted inside a slideway of the box, the compression spring (41) is in contact with the slide (43) at one end and fixed on the box at the other end; the metal dome (42) is mounted on the slide, its one end is connected with the soft conductor (44), while the other end is welded with the second pin (312) of the overvoltage protection component when it is in normal condition, but when the overvoltage protection component is in abnormal condition and causes this end to separate from the second pin (312) of the overvoltage protection component, an elastic restoring force of the compression spring is applied on the slide which drives the metal dome to move to a first limit wall (202) on the box, the soft conductor (44) is connected with the second electrode (7); the arc suppressing apparatus (5) comprises an arc chute assembly (51), a first arc striking sheet (52), a second arc striking sheet (53), a turning block (54) and a torsional spring (55); wherein: the turning block (54) is a bar-type block with an arc reflector plate (541) provided at one end, a mounting hole (544) at the other end and a spark chamber (542) at a part close to the arc reflector plate, the turning block is attached to a pin roll (204) on the box through the mounting hole (544) at its end and is hinged with this pin roll whose position is such that: when the overvoltage protection component is in normal condition, a side at an end of the turning block with the arc reflector plate (541) is in contact with the metal dome, but when the overvoltage protection component is in abnormal condition and causes the metal dome to separate from the overvoltage protection component, the turning block moves to a second limit wall (203) on the box under the action of the torsional spring (55) and the spark chamber (542) on the turning block covers the second pin of the overvoltage protection component separated from the metal dome; the torsional spring (55) is mounted on the turning block and is connected with the pin roll (204); the arc chute assembly (51) is installed inside the arc extinguishing chamber surrounded by the box (2) and the casing; a first arc striking sheet (52) has one end connected with or close to a left end of the arc chute assembly (51) and the other end positioned on the box and close to the first limit wall (202); a second arc striking sheet (53) has one end connected with or close to a right end of the arc chute assembly (51) and the other end positioned on the box and close to the second limit wall.

2. The high-safety surge protective device according to claim 1 further comprises an indicating device (6) which comprises a green display sheet (61) and a red label (62), wherein the red label (62) is attached on the upper end face of the slide (43) and the green display sheet (61) is hinged on the box, when the overvoltage protection component is in normal condition, the green display sheet (61) is on the slide (43) and is hence revealed, but when the overvoltage protection component is in abnormal condition and causes the metal dome to separate from it, the green display sheet (61) turns to the side of the box under the action of the slide and the red label attached on the upper end of the slide (43) is hence revealed, A transparent window (12) is provided at the top of the housing (11) of the casing from where the green display sheet (61) and the red label (62) are revealed.

3. The high-safety surge protective device according to claim 1, wherein the metal dome (42) comprises successively an arc guide end (421), a welding contact face (422), a connecting arm (423), and a fixed end (424).

4. The high-safety surge protective device according to claim 1, wherein an air outlet of the arc extinguishing chamber (201) is made on the box and an exhaust port (111) is made at the part on the housing (11) of the casing towards the air outlet of the arc extinguishing chamber.

5. The high-safety surge protective device according to claim 3, wherein an air outlet of the arc extinguishing chamber (201) is made on the box and an exhaust port (111) is made at the part on the housing (11) of the casing towards the air outlet of the arc extinguishing chamber.

6. The high-safety surge protective device according to claim 1, wherein the turning block (54) has a guide track groove (543) between the spark chamber (542) and the mounting hole (544), and a guide track (205) matching the guide track groove is mounted at the corresponding part on the box.

7. The high-safety surge protective device according to claim 3, wherein the turning block (54) has a guide track groove (543) between the spark chamber (542) and the mounting hole (544), and a guide track (205) matching the guide track groove is mounted at the corresponding part on the box.

8. The high-safety surge protective device according to claim 1, wherein the second arc striking sheet (53) is V-bulged at the part close to the second pin (312) of the overvoltage protection component.

9. The high-safety surge protective device according to claim 1, wherein the metal dome (42) is made of elastic copper and the soft conductor (44) is a braided annealed copper wire.

10. The high-safety surge protective device according to claim 1, wherein the casing (1), the box (2), the slide (43) and the turning block (54) are made of gassing insulating material.

11. The high-safety surge protective device according to claim 2, wherein the metal dome (42) comprises successively an arc guide end (421), a welding contact face (422), a connecting arm (423), and a fixed end (424).

12. The high-safety surge protective device according to claim 2, wherein an air outlet of the arc extinguishing chamber (201) is made on the box and an exhaust port (111) is made at the part on the housing (11) of the casing towards the air outlet of the arc extinguishing chamber.

13. The high-safety surge protective device according to claim 11, wherein an air outlet of the arc extinguishing chamber (201) is made on the box and an exhaust port (111) is made at the part on the housing (11) of the casing towards the air outlet of the arc extinguishing chamber.

14. The high-safety surge protective device according to claim 2, wherein the turning block (54) has a guide track groove (543) between the spark chamber (542) and the mounting hole (544), and a guide track (205) matching the guide track groove is mounted at the corresponding part on the box.

15. The high-safety surge protective device according to claim 11, wherein the turning block (54) has a guide track groove (543) between the spark chamber (542) and the mounting hole (544), and a guide track (205) matching the guide track groove is mounted at the corresponding part on the box.

16. The high-safety surge protective device according to claim 2, wherein the second arc striking sheet (53) is V-bulged at the part close to the second pin (312) of the overvoltage protection component.

17. The high-safety surge protective device according to claim 2, wherein the metal dome (42) is made of elastic copper and the soft conductor (44) is a braided annealed copper wire.

18. The high-safety surge protective device according to claim 2, wherein the casing (1), the box (2), the slide (43) and the turning block (54) are made of gassing insulating material.

* * * * *